United States Patent [19]

Palamara et al.

[11] Patent Number: 4,485,604

[45] Date of Patent: Dec. 4, 1984

[54] MODULAR BUILDING ELEMENTS WHICH FORM WHEN ASSEMBLED A NETWORK OF CONGLOMERATE OR REINFORCED CONCRETE TO FORM A BEARING STRUCTURE WHICH IS ALSO ANTI-SEISMIC

[76] Inventors: Rocco Palamara; Giovanni Palamara; Bruno Palamara, all of Colle Palombara, 00039 Zagarolo/Roma, Italy

[21] Appl. No.: 411,698

[22] Filed: Aug. 26, 1982

[30] Foreign Application Priority Data

Mar. 9, 1981 [IT] Italy ..... 47978 A/81
Mar. 9, 1982 [EP] European Pat. Off. ..... 82830050

[51] Int. Cl.[3] ..... E04B 2/00

[52] U.S. Cl. ..... 52/436; 52/259; 52/600; 52/606

[58] Field of Search ..... 52/436, 438, 439, 415, 52/259, 606, 600, 421

[56] References Cited

U.S. PATENT DOCUMENTS

| | | | |
|---|---|---|---|
| 3,102,367 | 9/1963 | Pedersen et al. | 52/437 X |
| 3,650,079 | 3/1972 | Lubin | 52/439 X |
| 4,295,313 | 10/1981 | Rassias | 52/437 |
| 4,341,049 | 7/1982 | Hsi | 52/421 |

*Primary Examiner*—J. Karl Bell

*Attorney, Agent, or Firm*—McAulay, Fields, Fisher, Goldstein & Nissen

[57] ABSTRACT

Modular building elements which form when assembled a network of conglomerate or reinforced concrete as a bearing structure which is also anti-seismic.

The modular elements are to be used for constructing flat or flat and/or vaulted brickwork, with or without air spaces. Each type of element is completed by a polyvalent modular element to be used as a single accessory for any corner, meeting point, cross wall attachment, etc. All the modular elements are equipped with groove devices suited to their particular characteristics to ensure that the assembled structure seals in conglomerate in each point, uninterrupted throughout the entire brickwork. The conglomerate network formed by the combination of all the molding characteristic of the modules is made up of vertical and horizontal seams designed to replace the pillars and beams of a reinforced concrete framework. This is anchored to the modular elements, at the same time attaching them to one another.

The resulting structure allows construction of a building requiring no framework of reinforced concrete pillars and beams. When resistant modular elements are used, they contribute to the bearing function of the structure. When non-resistant modular elements are used, the network alone assumes the bearing function (FIG. 7).

32 Claims, 12 Drawing Figures

MODULAR BUILDING ELEMENTS WHICH FORM WHEN ASSEMBLED A NETWORK OF CONGLOMERATE OR REINFORCED CONCRETE TO FORM A BEARING STRUCTURE WHICH IS ALSO ANTI-SEISMIC

This invention concerns modular building elements in any material used to form a network of conglomerate, or reinforced concrete, whose moldings create a true symbiosis between elements and network, of rapid construction, to form a bearing structure with anti-seismic properties.

Earthquake stricken areas require rapid reconstruction using means suited to that end, while at the same time ensuring strong, resistant buildings.

Current construction involves a reinforced concrete framework consisting of pillars and beams, within which brickwork is raised to form the outer walls and the inner dividing walls. The brickwork is raised between the pillars and beams with no effective bonding between the latter and said brickwork. In other words, the reinforced concrete acts as bearing structure and the brickwork as covering or dividing elements.

There have been many proposals to form the brickwork using bricks, cement blocks, or modular elements of various materials with vertical and horizontal openings for pouring conglomerate and, eventually, for passing iron rods to form a type of reinforcement.

During a thorough analysis of the state of the art, the applicants became convinced that while the above proposals can reinforce brickwork, they do not really form a bearing structure to replace the pillar and beam framework while also serving as covering and closure.

In fact the modular elements, bricks or blocks currently are limited to providing overlaying and grooving to form the conglomerate seal of the brickwork and to ensuring passage of the conglomerate flow and placement of any iron rods. However, these elements are not molded to form a network with one another, in which the vertical columns replace the pillars and the horizontal rows the beams. For example, the horizontal rows are too small to assume the function of the beams, or the vertical columns are larger than necessary for their function.

Furthermore, the current state of the art includes no modular elements with characteristics such that it forms a structurally self-sufficient network independent of whether or not the modular elements are resistant, that is made of hard and compact materials, like terra cotta, cement, stone, etc., or non-resistant, that is, of the type with non-cementable air spaces or made of weak materials like wood, plaster, polystyrene, expanded clay, etc.

When the elements are overlaid, moreover, the bond between them is entrusted to the simple placement of one element on another. In fact, the conglomerate runs through horizontal channels formed between adjacent elements along the flat, parallel sides; the conglomerate thus cannot penetrate the areas of contact between the overlaid elements to contribute to their reciprocal anchoring since the contact surfaces are flat for their entire length and leave no space on the sides of the horizontal channels.

Furthermore, there are no moldings in the blocks or elements which can after the conglomerate is poured, anchor the network to the elements and respond to both vertical and horizontal pressures, contributing in this way to the formation of a single intimate body between network and modular elements, indispensable to an antisiesmic function.

To solve certain problems such as elements to seal the end of the wall, or for right or left corners, or for attaching to a cross wall, etc., modular elements have been proposed to solve each problem, but none of them resolves them all. There exists no polyvalent modular element which can by itself be used for any of the above problems and so can replace the others.

Finally, no modular elements exist which can be used indifferently for flat brickwork and vaults or arches, do not require that the arch or vault under construction be of a predetermined curvature, leaving said curvature to be determined at the user's discretion, and allow a bearing structure to be built autonomous of a reinforced concrete framework.

The state of the art is extremely large. The applicants limit themselves to citing only some of the most significant documents pertaining to flat brickwork.

For example, the U.S. patents include: U.S. Pat. Nos. 952,080 (McIntyre), 1,084,098 (McIntyre), 3,968,615 (Ivany), and 4,075,808 (Pearlman). 2,186,712 (Stamm) and 2,736,188 (Wilhelm) concern blocks with no conglomerate poured after they are assembled.

German patents include DE-PS No. 677,922 (Johner), DE-PS No. 841,339 (Spring), DE-PS No. 816,452 (Teubner).

British patents include GB-PS No. 508,987 (Ensor), GB-PS 176,031 (Deyes) and GB-PS No. 827,508 (Anthony).

French Pat. No. 465,102 (Wagon) is cited.

In particular, French Pat. No. 936,739 concerns a preferably terra cotta element which can be used indifferently for flat or vault brickwork, with no need for mortar or framing. This modular element is parallepiped in shape, with an isosceles trapezoid as base bearing an inclined longitudinal dove tail rib on one of its side surfaces and a dove tail groove inclined in the other direction on the other surface. Superimposing two elements with ribs and grooves of opposite orientation gives rise to an arch. Superimposing them with ribs and grooves of the same orientation gives rise to a flat work. Obviously, these elements restrict the arch to a predetermined curvature which cannot be established at the moment of use. Furthermore, these elements do not give rise to an intimate bond between network and modular elements.

The aim of this invention is thus to propose modular building elements which can form an anti-seismic bearing structure which combines the functions of the pillar and beam framework and the covering brickwork; and in which the superimposed elements are bound and anchored to the network to form a single intimate body with it even near the contact areas.

A further aim of this invention is to realize elements as above equipped with moldings to form a network in which the vertical columns assume the function of the pillars and the horizontal rows that of the beams, in practice replacing them within the brick work itself, where both columns and rows are of the proper proportion to satisfy weight and stress requirements. A further aim of this invention is to realize a network of the type described which is self-sufficient structurally, independent of whether or not the modular elements are resistant, that is, made of hard and compact materials like terra cotta, cement, stone, etc., or non-resistant, that is of the type with noncementable air spaces or made of weak materials like wood, plaster, polystyrene, etc.

Another aim of this invention is that when the elements are laid on one another, the bond between them is not left to the simple placement of one element on another, but rather the conglomerate peripherically between the contact areas of the elements to contribute to their reciprocal anchoring.

A further aim of this invention is to provide the modular elements with moldings which, once the conglomerate is poured, give rise to means to anchor the network to the elements to equip them to withstand any stress, contributing in this way to the formation of an intimate single body between the network and the modular elements.

A further aim of this invention is to propse a modular element as illustrated polyvalent in function to replace accessory elements used for end of wall closings, right and left corners, attaching cross walls, etc.

A further aim of this invention is to supply the elements of a groove system for automatic placement of the element on the wall to serve as a sealed covering, which is incorporated in the mass of brick so as to be protected from easy breaking and to satisfy the requirements raised by coupling of polyvalent modular elements replacing accessory elements with other modular elements.

The final aim of this invention is to propose a modular element as described above which can be used indifferently for flat brickwork and vaulted or arched brickwork, while not requiring that the arch under construction be of a predetermined curvature, so the operator can thus determine on site the value of said curvature, and which at the same time allows a bearing structure to be formed independent of a reinforced concrete framework.

The invention will be described in more detail with reference to various embodiments illustrated in an exemplificative and non-limiting way in the attached drawings, FIGS. 1–12.

Figure 1:
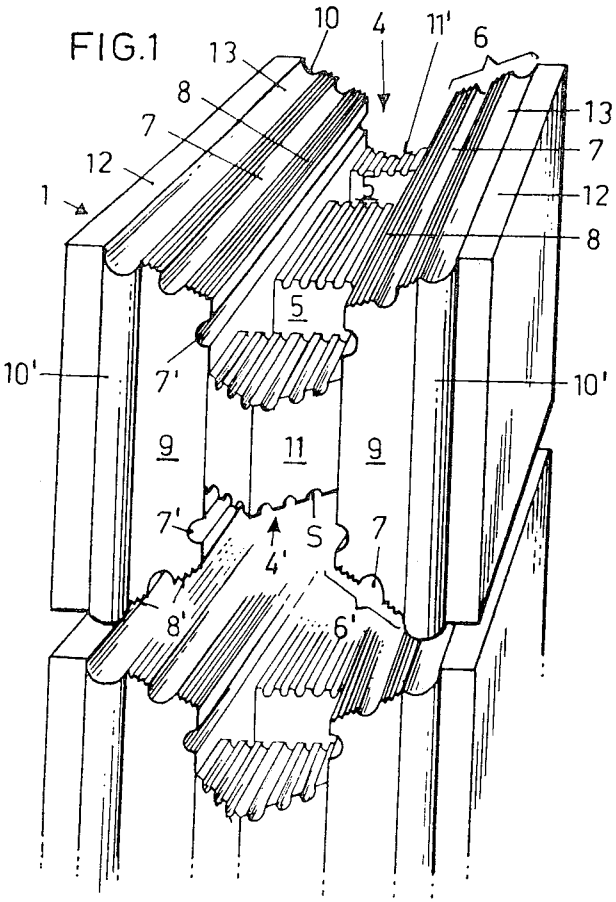
FIG. 1 shows a perspective view of two modular elements superimposed for the construction of flat brickwork.

FIG. 1 shows examples of two modular elements for construction of flat brickwork. One immediately notes the support planes 12 with the upper grooves 13 and the corresponding lower coping (not shown) running near them, while the vertical surface joining the elements has grooves 10 and corresponding coping 10'. Grooves 13 and 10 and coping 13' and 10' run on the sides of the element along a single continuous perimetrical sealing strip placed on the vertical plane itself. Said perimetrical lines are protected on the outside by support planes 12 running with constant thickness along the sides of said strips. All these grooves and copings serve to seal the conglomerate between the overlaid and side-by-side elements, and above all guarantee the seal even in the points where the modular elements are coupled with polyvalent elements.

Starting from the gooves 13, or the coping opposite, the modular elements, indicated generically as 1, show upper and lower planes 6 and 6' inclined toward the inside and interrupted to form parallel upper and lower channels 4 and 4'. Channels 5 and 5' are shown running vertically. When the elements are superimposed, the center line of each one corresponds to the vertical plane where the underlying and overlying elements are joined, so that vertical channels 5 are all aligned on a single straight vertical line from the ground to the top of the brickwork. Channels 4 and 4' are in turn all aligned on a straight horizontal line. It is important to note how the support areas of the two superimposed elements are limited to planes 12 and to grooves 13 or the coping opposite. Since planes 6 and 6' are inclined, the entire space between grooves 13 and the copings opposite and channels 4 and 4' is free; when assembled, these form actual wings beside the channels. Conglomerate penetrates into these spaces to form a layer between the overlaid elements so that the bond between them is not entrusted to simply resting on one another but is instead an intimate union with the conglomerate itself.

Planes 6 and 6' also have seams 7, while the sides each have upper and lower seams 7'. The seams 7 serve to anchor the module element against transverse stress, connecting the side parts to the central nucleus of the network, and to each other via the network; seams 7' serve to anchor them against vertical stress and to anchor overlaid elements via the network.

Prehensile teeth 8 and 8' are provided along planes 6, 6' alongside seams 7 to contribute to an intimate bond between the modular element and the network. Pronounced groovings S are provided along the bottom of channels 4, 4'. In effect, these are necessary only on the channel 4 or 4' which is underneath when assembled, to allow the element to be attached to the network at that point even if an air pocket is formed.

The vertical surfaces where elements 1 are joined in turn present inclined planes 9. Corresponding to the tongue 11 on a vertical joining surface is a vertical cavity 11' in the opposite surface of the element. The tongue 11 serves both as a groove protuberance to be lodged in corresponding cavity 11' as well as a means for immediately determing the direction of the element.

Figure 7:
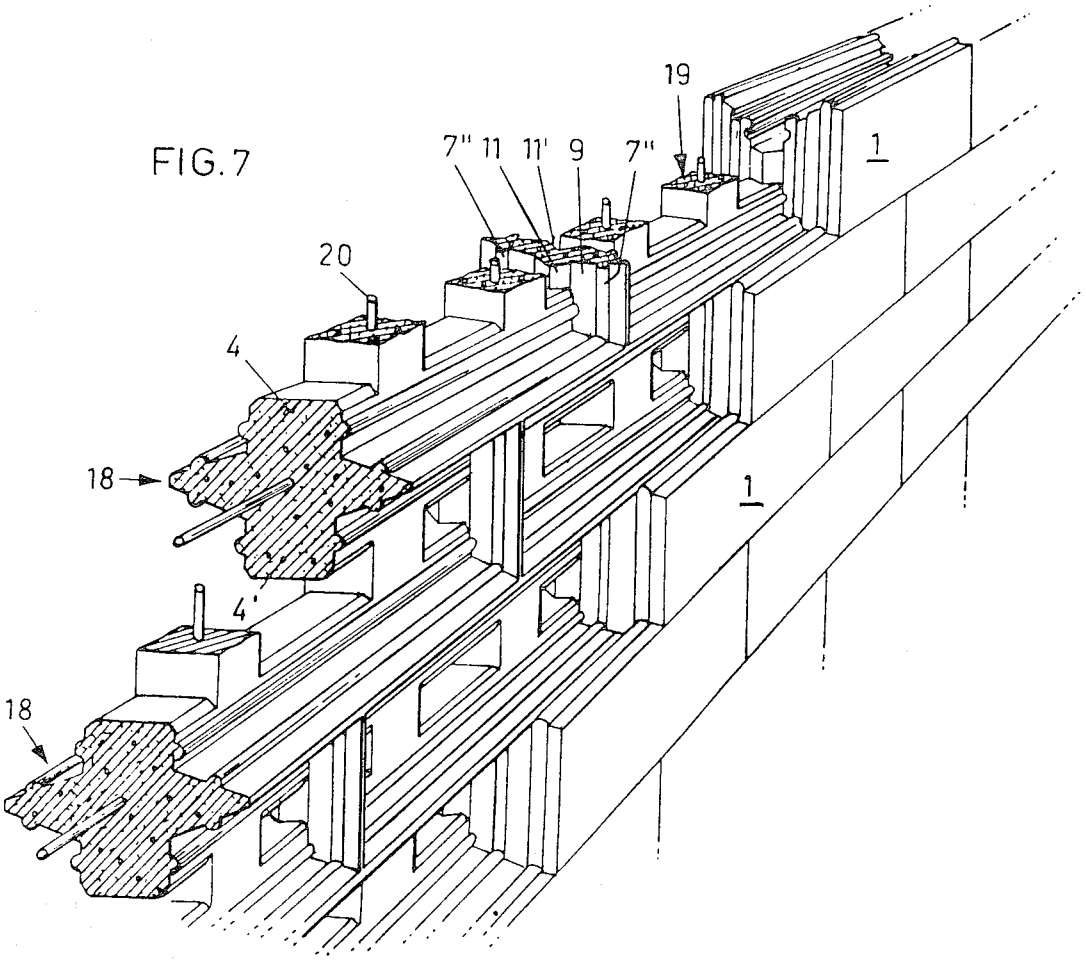
FIG. 7 shows a perspective view similar to that of FIG. 5, in which the modular elements show a free space in between while still effecting contact between the groove devices and the vertical support planes.

While the two assembled modular elements always form a seal between grooves 10 and coping 10', the planes 9, tongue 11 and opposite cavity 11' may have angles which allow adherence between them (FIG. 5) or which create a more or less extensive space for the conglomerate to be poured between the two frontons of the elements (FIG. 7). The latter possibility is particularly advantageous in situations where elements made of weak materials are used: they are completely incorporated, while the network extending along the transverse vertical plane forms by itself the support abutments needed for structural stability. Indeed, the latter are otherwise not quaranteed in view of the weakness of the modular element. The cementable areas between the frontons may develop in a manner very similar to the areas (wings) alongside the horizontal channels 4 and 4', especially if seams 7'' (FIG. 10) are provided on the inclined vertical plane 9 in analogy with seams 7 and 7'.

Another case in which the cementable spaces between the vertical frontons is of particular advantage is that in FIG. 10, discussed below.

Figure 10:
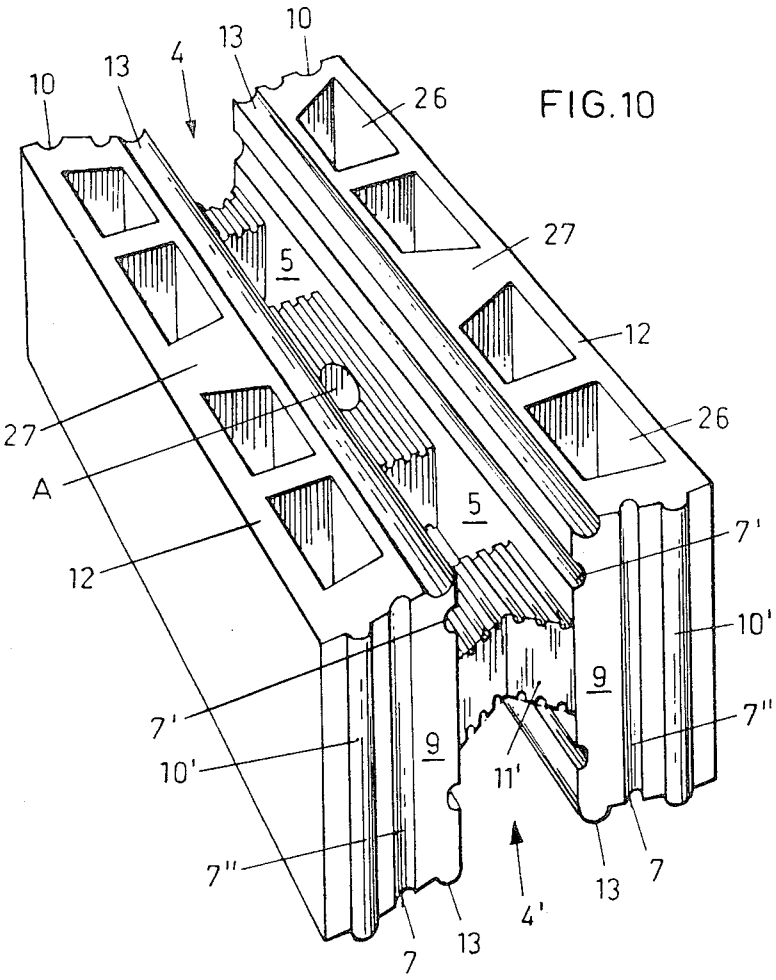
FIG. 10 shows a perspective view of a modular element with vertical air chambers outside the sealing grooves and coping.

Unlike the spaces formed when the elements are laid on top of one another, those formed when they are assembled next to one another do not pass along a single straight line, except in situations as shown in FIG. 10, since the bottom of channel 4 is on the plane underneath. However, they ensure the uninterrupted continuity of the structure from the moment in which there are no walls to interrupt the flow of mortar inside all the cavities in the brickwork.

Finally, note how the modular element in its entirety has filled and empty spaces distributed so as to completely eliminate weak areas. In fact, the longitudinal side faces are strong, continuous, compact, uninterrupted masses which are integral with a central mass and two equally strong masses at the interior ends, where the central masses at the ends of channels 4 and 4' keep the ends of the side faces united. Since the side faces and the central masses are so sturdy, the modular element and so the entire structure can be lighter while the network remains as before, either by having openings in the side masses and/or by using lighter materials to manufacture the modular element. The reason for this should be recognized in the function of planes 6 and 6' and eventually in that of the cementable free spaces between the vertical frontons, which said planes 6 and 6' allow to be incorporated by the conglomerate with most of the side masses by forming side wings.

Figure 2:
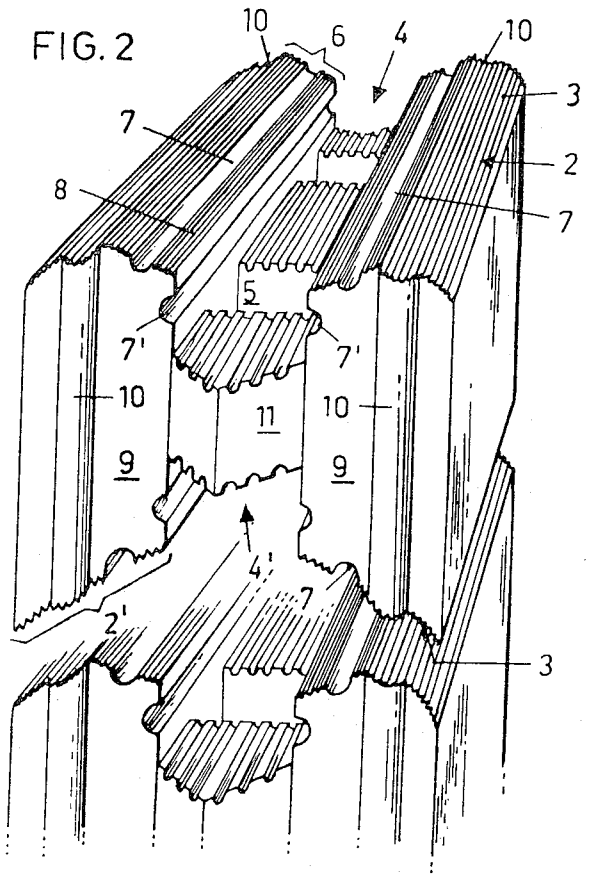
FIG. 2 shows a prospective view of two modular elements superimposed for the construction of vaulted or arched brickwork and, indifferently, for flat brickwork.

FIG. 2 represents an example of two modular elements generically indicated with 1', for construction of vaulted or arched brickwork. In this figure, they are shown in a position overlying a flat brickwork, since they may be used indifferently in both cases and they share fundamental characteristics in terms of the bond between them and with the network in both cases (see FIG. 3).

The support planes of FIG. 1 are replaced in this case with upper and lower sections 2 and 2' shaped as an arc of a circle with equal radii R and R'. These sections 2 and 2' are equipped with very fine parallel grooves of equal size, like teeth. In this way elements 1' are geometrically matchable and guarantee the seal of the conglomerate in a horizontal sense. Said seal is guaranteed in the vertical sense by grooves 10 on one of the vertical joining faces and by corresponding coping 10' on the opposite face. Said upper and lower sections 2 and 2' may also be smooth surfaces, that is without said teeth. Or, upper sections 2 may have teeth while lower sections 2' are smooth, without teeth, or vice versa. This gives a more completely possibility of inclination between overlaid elements.

Starting from the inner edge of planes 6 note that walls descend vertically and are equipped with seams 7' in analogy with seams 7' in FIG. 1. Inclined planes 6 continue, in analogy with planes 6 in FIG. 1, equipped with seams 7 in analogy with seams 7 in FIG. 1. At the end of the planes 6, the sides of channel 4 run down vertically in analogy with channel 4 in FIG. 1. Channels 5 run vertically.

Lower sections 2' run uninterrupted from the outer side edges of elements 1 up to the respective side of lower horizontal channel 4'. This is designed to provide more surface area in the case of a vault or arch construction (see FIG. 4). Near the sides of lower channel 4', sections 2' are equipped with seams 7 with the same function as upper seams 7; the sides of lower channel 4' are in turn equipped with seams 7' with the same function as seams 7 in the sides of the upper channel. As already mentioned for FIG. 1, seams 7 serve to anchor the modular element against transverse stress by attaching the side parts to the central nucleus of the network and to each other via the network; seams 7' serve to anchor it against vertical stress and to anchor overlaid elements via the network.

Along planes 6 on the sides of seams 7, prehensile teeth 8 are provided to contribute to an intimate bond between the modular element and the network. The bottom parts of channels 4 and 4' are equipped with pronounced grooves S. These in effect serve only on the bottom of channel 4 or 4', which when assembled is underneath, to allow the element to be attached to the network at that point, even when air pockets are formed.

Figures 3, 4, 12:
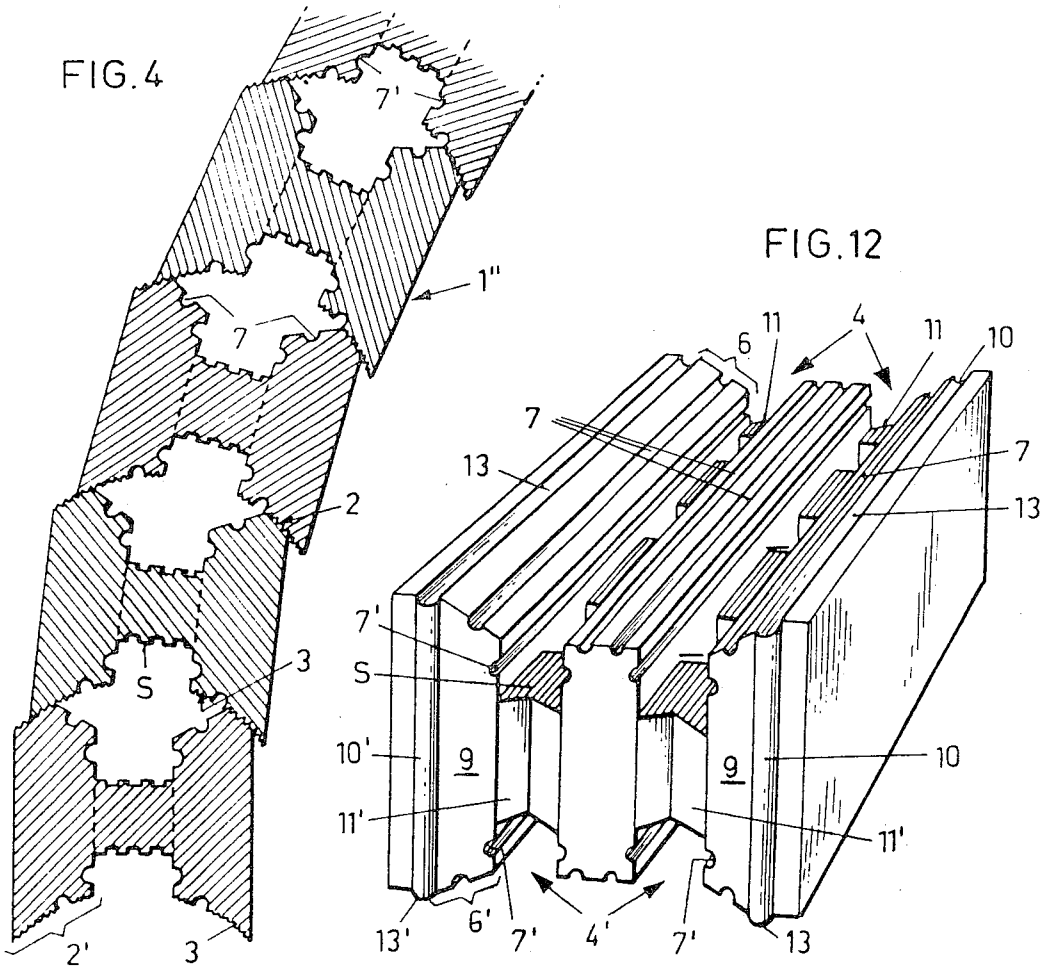
FIG. 3 shows a cross section of the elements in FIG. 2 superimposed for flat work.
FIG. 4 shows a vertical section of the elements in FIG. 2 superimposed for a vault.
FIG. 12 shows a perspective view of a double network modular element.

FIG. 4 shows modular elements 1' used in constructing a vault. Since the radius R of sections 2 equals that R' of sections 2', and since grooves 3 are equal in size, one element may be placed out of phase with the one below it in addition to being placed right on top. In this way, the radius of curvature of the vault may be selected on site, with no requirements tied to preselected elements.

Figures 5, 6:
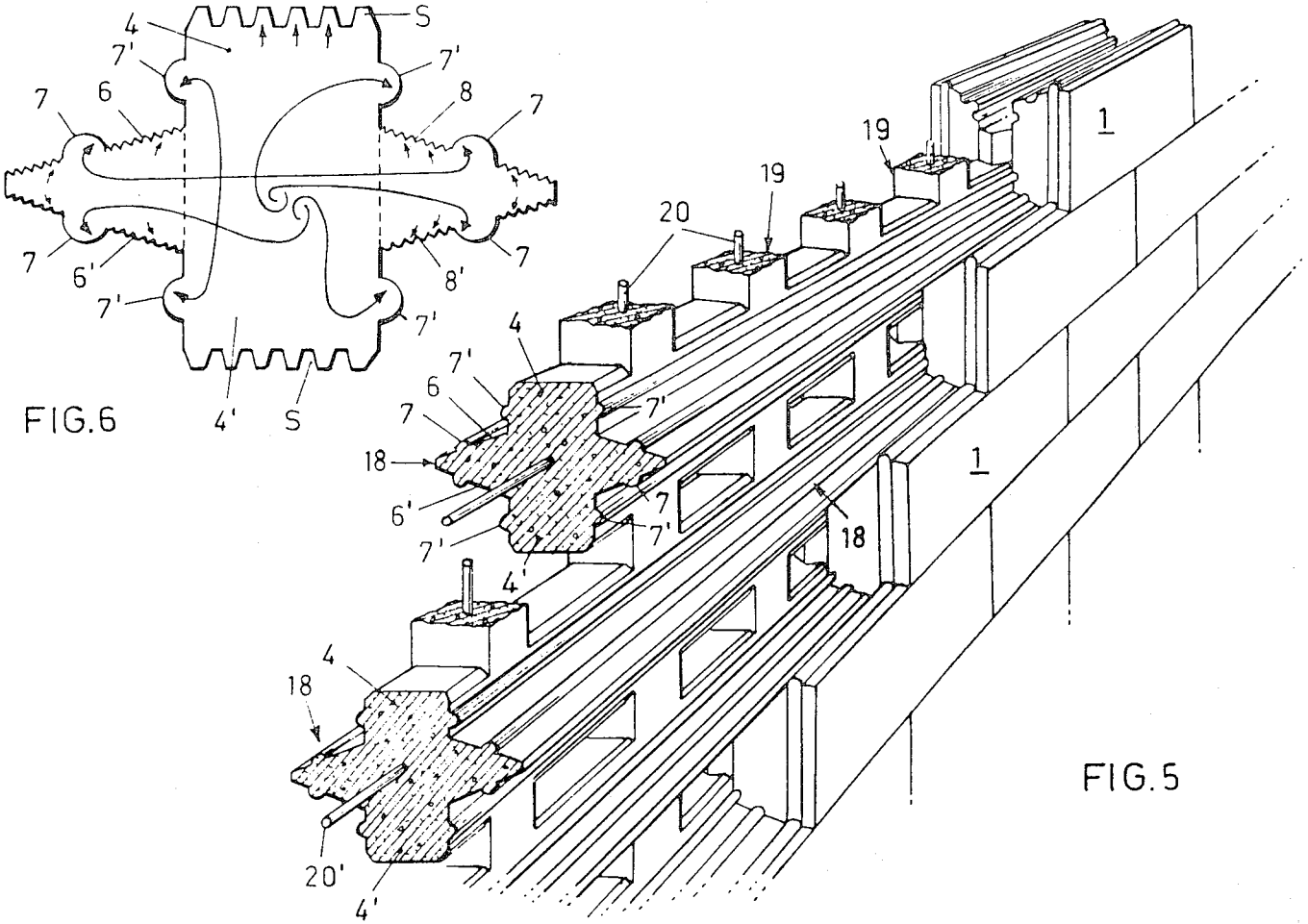
FIG. 5 shows a perspective view of a structure realized with modular elements as in FIG. 1, which shows the molding of the internal network obtained with said elements when the latter are in direct contact.
FIG. 6 shows a cross section of a detail of the network in FIG. 5 where the anchoring action of the superimposed elements, the network elements, and between the opposite sides of the same element through the network is shown.

FIG. 5 shows a bearing structure made of modular elements according to this invention placed in direct contact. In particular, modular elements 1 were used here. One notes immediately that the shape of the network formed between modular elements reproduces that of the filled and empty spaces of the modular elements 1 as described above, as well as the shape of the inclined planes 6 and 6', seams 7 and 7', pronounced grooves S and teeth 8 and 8'. One notes how planes 6 and 6' have formed true wings 6 and 6' in correspondence, protruding from the overlaid modular elements along the support line to form a single body with them. Also seams 7 and 7' form transverse and vertical anchorages. One notes also how seams 18 and 19 are continuous and aligned along the same straight line, as well as how they are intimately bound via the intersection of channels 4, 4' and 5. Iron rods 20' and 20 may be passed through channels 4, 4' and 5 respectively.

FIG. 5 also shows how the network formed in the molded cavities of the modular elements described above is of the proper proportions and strength at all points to form a true bearing structure intimately one with the modular elements making it up. Because of the operative cooperation between all the moldings in the elements described above, there exists a true symbiosis between vertical seams 19 (which thus function as pillars), horizontal seams 18 (which function as beams) and the modular elements. The two seams 18 and 19 perform the same function in terms of structural strength, but are different and distinct from one another for various functions.

Indeed, the vertical seams 19 formed by channels 5 specifically function to bear weight, to bond overlaid modular elements together, and to hold the vertical iron rods. In particular, these in any case support the structure: only partially if the modular elements are resistant and so also serve this function; and completely and autonomously if the modular elements are not resistant and so do not contribute to this aspect. They are preferably square in cross section, or in any case, strong.

On the other hand, horizontal seams 18 are quite particularly designed. They are the product of the operative combination of inclined planes 6 and 6', channels 4 and 4', seams 7 and 7', pronounced seams S and prehensile teeth 8 and 8'. The relationship between seams 18 and the modular elements is more extensive. These have the specific function to uniformly distribute the weight along the brickwork and along vertical seams 19, thus serving an equilibrating role. The center is preferably rectangular in cross section with the longer sides in the up and down direction, in analogy with the beams of a framework.

As already mentioned, planes 6 and 6' form parallel wings on the sides of this central part, with surfaces descending toward the outside of the modular elements. FIG. 6 shows (arrows) how coping 7 and 7' performs a true general anchoring function in the assembled modular elements, both vertically between overlaid elements by anchoring them to one another as well as the network and horizontally by anchoring the sides to the center of the network as well as the two sides of the same element to one another via the network. Arising from the holding effect of the winged grooves, this latter function makes up for any structural need due to the element's internal channeling. All the attachment grooves should absolutely not be considered as general prehensile molding, since they are very specific in function, and their solidity and co-penetration in the element are decisive. Their solidity is clearly shown in the figure.

The winged extension is also very important in that it removes any constraints on the central part of horizontal seam 18 placed by the dimensions of the modular element. This means that whatever size modular elements are used, the true horizontal seam, that is the rectangular central part, is never overloaded, thanks to the characteristics described, with waste conglomerate, determined beforehand to be superfluous in the specific calculation of the lift required and of the equilibrated relationship in size and proportion with the vertical seams. These possibilities are determining with regard to the aims of the invention in terms of lift and anti-seismic properties since the load stress and flex of a reinforced structure and especially the telluric stress, tend to be released at any weak points in the structure. Therefore, as is well known, these uncompensated excesses of strength have repurcussions throughout the structure since they unload and concentrate stress in the weakest points to considerably aggravate the problem. In addition to being equilibrated between the crossed horizontal and vertical seams, the strength of the network is also uniform, and so it is able to breech the iron rod through the whole channel.

Equally important in terms of structural autonomy, both for an external framework (pillars and beams) and for non-resistant modular elements, is the starlike shape of the central part and the wings, in which the wings serve to push against the sides of the wall. This is very useful in terms of static function. Also useful in these terms, especially for non-resistant elements, are the wings to be realized by cementing the frontons of the elements next to one another (FIG. 7). Therefore, all the moldings of the modular elements according to this invention contribute individually and as a group to satisfy the aim of the invention. Furthermore, as shown in FIGS. 5 and 7, iron rods are to be incorporated into the network.

Figure 8:
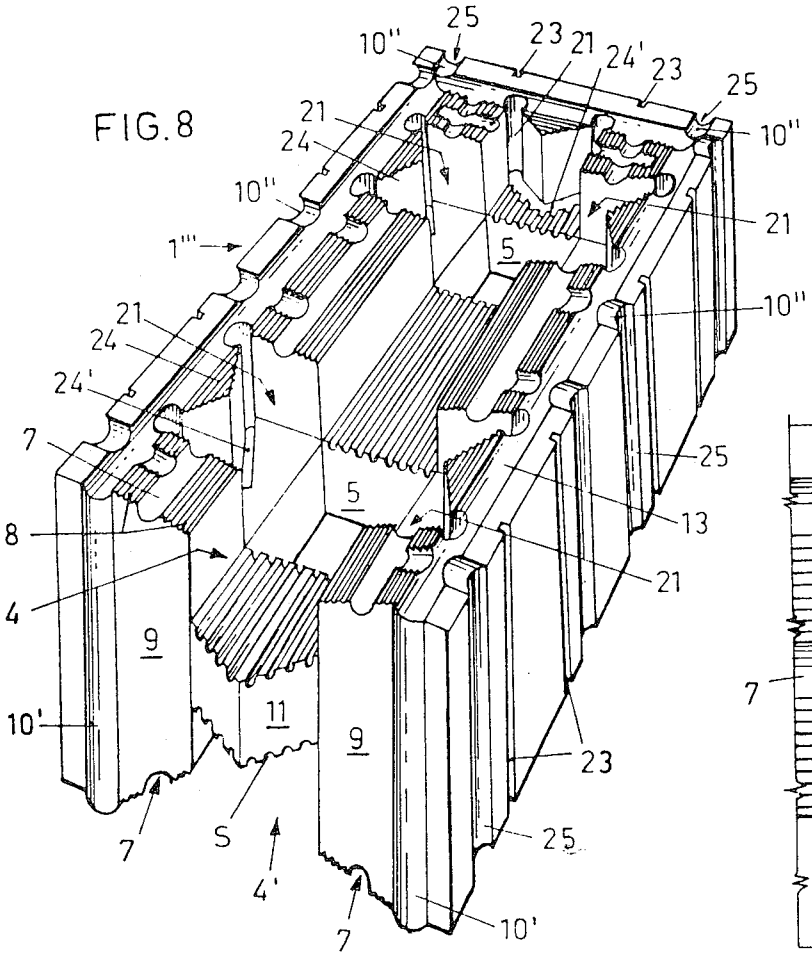
FIG. 8 shows a perpsective view of a polyvalent modular element to replace accessory elements.

FIG. 8 shows a polyvalent modular element generically indicated with 1''' to replace accessory elements used for wall-ends, right and left corners, attaching transverse walls on one or both sides of the wall, etc. Fundamentally, the molding characteristics are the same as those described for modular elements 1 and 1' (FIGS. 1 and 2). In fact, this polyvalent modular element may be realized in both forms. FIG. 8 shows an example of one like modular element 1. An exception is the seams 7', which in this case would be difficult to manufacture. In any case, the function of seams 7' may be considered as compensated for by a more important relationship of the modular element with the cement. Cavities 21 are designed to serve as outlets on the corresponding channels 4 of a paired element. Although not visible in the drawings, corresponding cavities 21' are of course found on the sides of channels 4'. Said cavities 21 and 21' are placed in twos on each longitudinal side and singly on the transverse fronton only. Of course, another cavity 21 may be provided on the other fronton.

Figure 9:
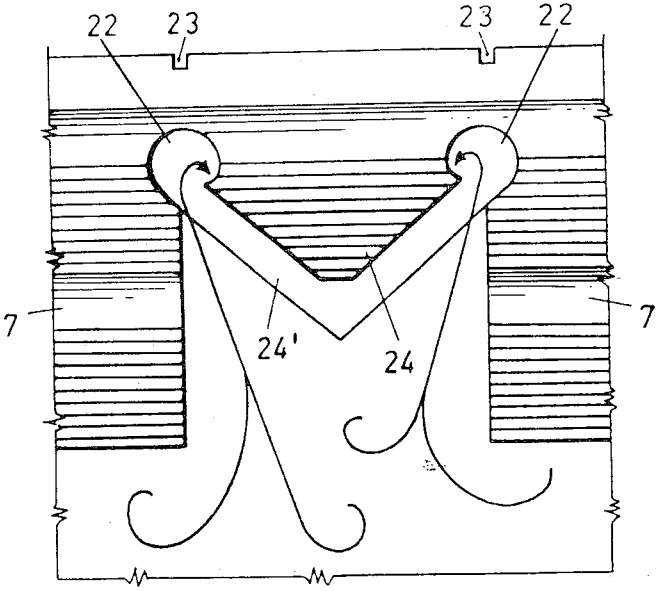
FIG. 9 shows a top view of a detail of a membrane area of the element in FIG. 7.

Therefore, a thinner section of the side of the element corresponds to each cavity 21 and 21'. As shown more clearly in FIG. 9, which shows a detail of this cavity, the side areas of the element in these points have been purposefully weakened along the inner grooves 22 and 22' which again to contribute to the weakening check the outer cogging 23, which may be eliminated when the material of the element is not particularly hard. On the inner side of these thinner sections, abutments 24 are provided toward the inside, with the aim of concentrating the break points along the lines corresponding to the grooves 22 with eventual cogging 23. In this way, a sharp hammer blow to said sections (which may be seen as membranes), causes a clean break with no shattering. Another aim of said abutments 24 is to allow, thanks to their mass itself, grooves 22 to have equal recesses to guarantee effective attachment of the conglomerate when the respective membrane is not broken because it is coupled with another modular element.

Furthermore, these abutments 24, again to facilitate sharp breaking of the membrane, may be provided at the bottom of depressions 24', or may be passages and interrupted, detached from the bottom and top of channels 4 and 4' respectively. This allows the entire membrane to be broken with a single hammer blow.

The polyvalent element also has vertical grooves 25 along all sides, at the sides of cogging 23, in order to form a seal with the element next to it, whose channels 4 and 4' must correspond to cavities 21 and 21'. Starting from the horizontal support planes 12, in correspondence with grooves 25, and along the entire transverse directrix from one plane 12 to the other, notches 10'' are provided for the coping 13' of an element overlaid transversely.

For the opposite plane, that is that supplied by the coping, correct placement and adherence of a brick laid transversely is guaranteed by cogging in the coping itself at the points corresponding to the support planes of the modular element placed on either of the two underlying membrane channels. These points of cogging are near the inlet for the open horizontal channel and in the central part, for double extension. The part of the element near the closed membrane fronton requires no cogging in the coping since this closes the sealed circuit inside the support plane.

One can see how breaking one or more membranes allows a corner to be formed, either right-hand or left-hand depending on which side is broken; for attaching a cross wall, both one side and the membrane fronton are broken; for forming a double cross wall two opposite side membranes are broken in addition to the fronton. One can also see how a wall is closed by simply using the element as is, rather than by using special accessories. It should be observed that with the aid of the polyvalent modular elements, the structure presents a continuous network throughout the the building, uninterrupted at corners, crossings, cross-walls, etc. Thus the iron rods incorporated in the network form an actual cage uninterrupted throughout the building.

In situations requiring brickwork which is lighter and/or has air spaces (air chambers, insulation), a type of modular element is used which while performing all the functions of the modular elements described for FIGS. 1, 2 and 7, is somewhat different.

As shown in FIG. 10, the modular element has grooves 13 and corresponding copings 13' further back than in FIGS. 1 and 2. On the outside of grooves 13 and copings 13', there are openings 26 which pass from one face to the other of the modular element. These are not to be filled with conglomerate, but rather are to serve as air chambers; as such they are isolated peripherically from the central part which will be occupied by the inner network. Support planes 12 are larger in surface area. The central openings 26 on both sides are placed somewhat apart (27) so that when two elements are placed on the center line of the element underneath, a space for cement is formed along the frontons of said elements which with planes 9 guarantees the openings 26 for the conglomerate to be poured. Also, in order to form a larger cementable space, the end dividers of channels 4 and 4' are not, as in FIGS. 1, 2 and 8, formed from a tongue 11 protruding from one side plus a cavity 11' on the other, but rather from two cavities 11 on both sides. The central mass dividing channels 4 and 4' has an opening with its center perfectly aligned with the element's center line. Therefore, when elements are placed one on top of another, vertical frontons are formed in a straight line along the entire brickwork where the iron rods may be inserted. Said frontons have the same winged shape as 2 and 8 in FIG. 1, formed horizontally from planes 6 and 6'. In this case, there are no horizontal seams of this shape since the grooves 13 and 13' have been pulled back. The space between horizontal planes 6 and 6' thus remains empty and also acts as an air chamber. Grooves 7'' run along planes 9 to attach the side by side element and the conglomerate to replace the missing horizontal grooves 7. The attachment of the sides of the elements to one another is aided by the fact that in the areas 27 the conglomerate goes beyond grooves 13 and coping 13'.

This element with vertical air spaces may of course be realized with sealing grooves of the arc of a circle type, with or without teeth, for construction of vaults.

This element with vertical air spaces is also associated with a corresponding membrane polyvalent modular element for the end-wall closure, for right and left corners, for attaching cross walls on one and/or both sides of the wall, etc. Fundamentally, this membrane polyvalent modular element has the same characteristics as described with reference to FIG. 8. However, they differ in that planes 6 and 6' are not inclined, in analogy with the described element with air spaces, but rather are flat, parallel to one another and horizontal to form a single surface with planes 12 for the entire width of the sides. Therefore, grooves 13 and coping 13' are further back than those in FIGS. 1 and 2, and are interrupted along the sections corresponding to cavities 21 and 21'.

On the other hand, grooves 10 and coping 10' extend further along the thickness of the flat, parallel planes 12. Naturally, the chambers 26 are discontinuous at the points where the perimetrical elements couple with the elements of FIG. 10. This polyvalent element may also be realized with sealing grooves of the arc of a circle type, with or without teeth, for construction of vaults.

Figure 11:
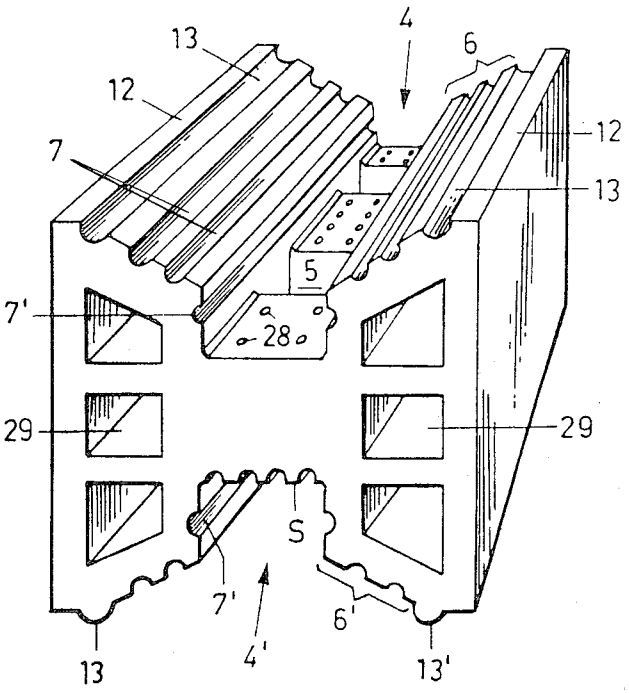
FIG. 11 shows a perspective view of a modular element with horizontal air chambers.

For a horizontal rather than vertical air space, the modular element shown in FIG. 11 is used. Although it fundamentally performs the same functions with regard to the network as all the other modular elements described, this element differs in some ways.

The grooves and copings for sealing the conglomerate are limited to grooves 13 and coping 13' since the horizontal air chambers 29 open out into the frontons. Since the presence of these air chambers 29 thins the space underlying planes 6 and 6', the seams 7 could not be of the same depth as those in the other modular elements. Therefore, planes 6 and 6' are each equipped with two shallower seams 7; the presence of two (or more) seams 7 on each plane makes teeth 8 and 8' superfluous. The pronounced seams S, seen in the figure in channel 4', are in fact also present in channel 4, but they have not been drawn to allow better visual comprehension of holes 28. The holes serve to lighten the central inner mass so as to equilibrate it with the side masses where the chambers 29 are located. In case pronounced seams S are absent, the holes 28 can act as outlets for air pockets.

This element with horizontal air spaces may of course be realized with sealing grooves of the arc of a circle type, with or without teeth, for construction of vaults.

This element with horizontal air spaces is also associated with a corresponding membrane polyvalent modular element for wall-end closure, etc. This differs by the absence of grooves 10 and 25 and coping 10'. Moreover, the two frontons are smooth, that is, with no seams or grooves. There are also no horizontal chambers 29. This polyvalent element may also be realized with sealing grooves of the arc of a circle type, with or without teeth, for construction of vaults.

For structures with particular strength requirements, the modular element shown in FIG. 12 is used. This element also has fundamentally the same functions as those previously described.

This element is characterized by a double row of channels 4 and 4' and by three vertical channels 5 for each channel 4 and 4'. Tongues 11 and the corresponding cavities 11' are at the ends of the channels 4 and 4'. Seams 7 and 7' are also doubled since the channels 4 and 4' are. The central plane containing the seams 7 is lower than the support planes 12 to allow connection between the two channels 4 and the two channels 4', all parallel to one another. However, the latter channels may be provided separately.

This double channel element may also be realized with sealing grooves of the arc of a circle type, with or without teeth, for construction of vaults.

This double channel element is associated with a corresponding membrane polyvalent modular element for end-wall closure, etc. This has the same characteristics as shown in FIG. 8, but adjusted for the number of horizontal and vertical channels of the element in FIG. 12. Therefore, there are three cavities 21 and 21' on the sides and two cavities 21 and 21' along one of the frontons with the same characteristics as described for the element in FIG. 8. The number of grooves 25 and notches 10'' in planes 12 is the same, as is the number of coggings in the coping of the plane opposite. This is due to the fact that although there are three channels on each side, the elements of this type are always attached in two points, that is in correspondence with one of the pairs of side cavities 21 and 21' and with the pair of central cavities 21 and 21', where the latter is always common to any one of the attachments. This polyvalent element may also be realized with sealing grooves of the arc of a circle type, with or without teeth, for construction of vaults. It should be noted that all the polyvalent elements for construction of flat and/or vaulted brickwork may also be realized as half bricks. Furthermore, all the modular elements described are extremely practical for rapid and simple placement.

The invention has been described and illustrated with reference to preferred embodiments. Of course, possible variants in arrangement, proportions and dimensions are possible without going beyond the bounds of the invention.

For example, the polyvalent element may indifferently have open grooves 10 or coping 10' on the fronton, although the former are preferred. Moreover, the frontons may be closed on both sides.

All the elements except for those in FIG. 10, may be realized with frontons made of smooth, parallel planes and with more horizontal or vertical channels.

In the element with vertical air spaces, the grooves 13 and 10 and copings 13' and 10' may be realized in a continuous closed circuit, both on planes 12 near the frontons and in correspondence with areas 27 on planes 12. Again, these same elements may be equipped with the side wings provided in the other elements by moving grooves 13 and coping 13' outside, along with grooves 10, coping 10', and chambers 26.

The modular elements with horizontal air spaces may be realized with frontons with moldings of the tongue 11 and corresponding cavity 11' type, as well as with planes 9 inclined for direct contact coupling. There may also be a closed circuit of grooves and coping 10 and 10' on the frontons along the inner edge of chambers 29.

Modular elements as described may also be realized as accessory corner elements (right hand or left hand), or T-shaped, or as closed or opened elements. Furthermore, modular elements for flat brickwork, for flat and/or vaulted brickwork, and with double or multiple channels may be modified for lightening and/or insulation by equipping them with empty, closed cavities in the side and/or central (in the case of the multiple channel modular element) masses. They may be filled with insulating material like polystyrene. In any case, the moldings need not be modified and the normal network is obtained.

Finally, it should be emphasized that the modular elements described and illustrated, in cooperation with the resulting network, give rise to a structure for building construction which requires no reinforced concrete framework consisting of pillars and beams, since both are reproduced in said structure.

Buildings may also be constructed by assembling prefabricated parts made with the structure as described.

We claim:

1. Modular building elements in any material to realize a flat and/or vaulted anti-seismic bearing structure which requires no reinforced concrete framework of pillars and beams and which is self-sufficient whether made of strong modular elements or not since in either case the modular elements are symbiotically bonded to the internal network they form, characterized by:

groove and coping devices (13,13';10,10';2,2') to seal conglomerate inside the structure;

inclined planes (6,6') running continuously along both longitudinal and vertical faces from said grooves (13,13';2,2') toward the inside, to form free spaces between overlaid elements in which the conglomerate takes form;

a continuous horizontal channel (4,4') along the center line underneath said inclined planes (6,6'), in each of said longitudinal faces;

continuous seams (7) along each of said planes (6,6') on the horizontal longitudinal faces, as devices to anchor the side-by-side elements to one another and to the network when the conglomerate is poured;

prehensile teeth (8,8') parallel to said seams (7), to contribute to the intimate bond between elements and network;

continuous seams (7') along the vertical walls of each of said continuous horizontal channels (4,4') as devices to anchor the overlaid elements to one another and to the network when the conglomerate is poured;

pronounced seams (S) along the bottom and top of said horizontal channels, to form in said free spaces and in said channels, horizontal seams of the network when the conglomerate is poured;

continuous inclined planes (9) from said groove and coping devices (10,10') toward the inside along both transverse faces, to form vertical free spaces between the side-by-side elements, in which the conglomerate takes form;

a tongue (11) between the two said inclined planes (9) from said groove and coping devices (10,10') along one of the transverse faces and a corresponding cavity (11') between the planes (9) of the opposite face; and continuous channels (5) made vertically to said horizontal channels (4,4') in which, after assembling and pouring of the conglomerate, the vertical seams of the network are formed.

2. Modular elements as claimed in claim 1, for flat brickwork, wherein:

said groove and coping devices to seal the conglomerate inside the structure consist, on the upper and lower longitudinal faces, of grooves (13) and copings (13') near the support planes (12), represented by flat smooth surfaces on the inner side of the overlaid elements, as well as, on the front and back transverse faces, of grooves (10) and coping (10') near the support planes (12) of the side by side elements on their internal side, where the grooves (13, 10) and coping (13',10') run in duplicate on the sides of the element along a single, continuous perimetrical sealing strip on the same vertical plane;

said inclined planes (6,6') from said grooves and coping (13,13') toward the inside are surfaces equipped with said continuous seams (7) with said prehensile teeth (8,8') on their sides, along both horizontal longitudinal faces.

3. Modular elements as claimed in claim 1 for the construction of both flat and vaulted brickwork, wherein:

said groove and coping devices to seal the conglomerate inside the structure consist of arc of a circle sections (2) along the upper longitudinal face, equipped with seams (3) to act as teeth, acting at the same time as support planes (12) and, along the lower longitudinal face, as arc of a circle sections (2') which also act at the same time as support planes, with a radius of curvature (R') equal to that (R) of said sections (2) on the upper face, as well as of grooves (10) and coping (10') near the support planes along the transverse faces, where the upper and lower (2 upper and lower sides of said said closed transverse vertical face;

said groove devices to seal the conglomerate inside the structure along the sides of said single transverse vertical face, formed by said inclined planes (9), are grooves (10); and also wherein:

cavities (21,21') are present on the vertical longitudinal surfaces at the sides of the upper and lower horizontal channels (4,4') as well as inside of only one closed vertical transverse face, designed to form outlets on corresponding channels (4,4') of one element to be joined by breaking the corresponding thinner sections of the sides obtained by weakening them with interior holes (22) in correspondence with the upper channel (4) and holes (22') in correspondence with the lower channel (4'), at which they check the continuous external cogging;

abutments (24) are provided inside of and in correspondence with said thinner sections, which concentrate the breaking points along the lines where said holes (22) correspond with said cogging (23);

there are depressions at the base of said abutments (24) which facilitate breaking of said thinner sections, and said holes (22,22') are molded to attach with said abutments (24) to improve anchorage of the abutments in the conglomerate when the relative thin section of the side is not broken;

there are vertical grooves (25) on the sides of said and 2') arc sections, the grooves (10) and the coping (10') form a single continuous perimetrical sealing line inside all the support planes of the overlaid and side-by-side elements;

said inclined planes from said sealing and support tracks (2) to the inside have, on the upper longitudinal face, surface planes (6,6') equipped with said continuous seams (7) and with said prehensile teeth (8) alongside them; on the lower longitudinal face, consisting of extensions of the same arc sections (2') longer than that of the upper arc sections (2), the lower sections (2') are equipped with seams corresponding to the seams (7) in the planes (6) of the upper face.

4. Polyvalent modular elements to replace accessory elements used for wall-end closures, for right and left hand corners, and for attaching cross walls to one side and/or to both sides of the wall, integrative with modular elements for the construction of flat and/or vaulted brickwork as claimed in claim 2, wherein:

said continuous inclined planes (9) running from said groove and coping devices (10,10') to the inside are present only on one of the transverse faces, to form vertical free spaces between the side-by-side elements in which the conglomerate forms, the opposite transverse vertical face being closed;

said groove and coping devices (13,13') also being present on the upper and lower sides of said said closed transverse vertical face;

said groove devices to seal the conglomerate inside the structure along the sides of said single transverse vertical face, formed by said inclined planes (9), are grooves (10); and also wherein:

cavities (21,21') are present in the vertical longitudinal surfaces at the sides of the uppper and lower horizontal channels (4,4') as well as inside of only one closed vertical transverse face, designed to form outlets on corresponding channels (4,4') of one element to be joined by breaking the corresponding thinner sections of the sides obtained by weakening them with interior holes (22) in correspondence with the upper channel (4) and holes (22') in correspondence with the lower channel (4'), at which they check the continuous external cogging;

abutments (24) provided inside of and in correspondence with said thinner sections, which concentrate the breaking points along the lines where said holes (22) correspond with said cogging (23);

said abutments (24) having depressions at the base thereof which facilitate breaking of said thinner sections, and said holes (22,22') are molded to attach with said abutments (24) to improve anchorage of the abutments in the conglomerate when the relative thin section of the side is not broken;

said cogging (23) having vertical grooves (25) on the sides thereof for sealing the elements next to one another;

said element having notches (10') provided in correspondence with the grooves (25) along the entire transverse directrix of a horizontal support plane (12) to receive the coping (13') of the element next to it;

said coping having notches in the points corresponding to the support planes of an underlying modular element placed sideways;

the absence of longitudinal seams (7') in the vertical walls of the upper (4) and lower (4') channels being compensated for by the presence of the cavities (21,21') in said walls.

5. Polyvalent modular elements to replace accessory elements as claimed in claim 4, integrative with modular elements for the construction of flat and/or vaulted brickwork, wherein said groove and coping devices on the upper horizontal face are arc of a circle sections of equal radius of curvature extending on the edges of the lower horizontal channel (4'), both provided with seams (3) acting as teeth and serving at the same time as groove devices to seal the conglomerate inside the structure, where said groove devices (2,2') are also present on the upper and lower sides of the closed transverse vertical face.

6. Polyvalent modular elements to replace accessory elements as claimed in claim 4, integrative with modular elements equipped with vertical air spaces, wherein said groove and coping devices to seal the conglomerate inside the structure consist, on the upper and lower longitudinal faces, of grooves (13) and coping (13') along the edges of the walls of the respective horizontal channels (4,4'), such that said support planes (12) of overlaid elements extend for the entire width of the sides and are smooth, horizontal and parallel to one another, while said grooves (13) and coping (13') are interrupted along the sections corresponding to the cavities (21,21'), but in any case on the vertical face closing the element, run along the section corresponding to the upper (4) and lower (4') channel, to form a single peripheral circuit interrupted only by the element's open vertical face.

7. Polyvalent modular elements to replace the accessory elements as claimed in claim 4, integrative with modular elements equipped with horizontal air spaces, wherein said groove and coping devices are limited to the grooves (13) and coping (13') on the upper and lower horizontal faces respectively, on the sides of the modular elements, and on the transverse vertical fronton, being flat and smooth on the outside.

8. Polyvalent modular elements to replace accessory elements as claimed in claim 5, integrative with modular elements equipped with horizontal air spaces, wherein said support planes defined by said upper horizontal face are arc of a circle (2) sections extending to the beginning of said inclined planes (6), and on said lower horizontal face are arc of a circle (2') sections of equal radius of curvature extending until the edges of the lower horizontal channel (4'), and both sections being equipped with seams (3) acting as teeth and at the same time as groove devices to seal the conglomerate inside the structure, with the sides of the modular elements and the vertical transverse fronton flat and smooth on the outside.

9. Polyvalent modular elements to replace accessory elements as claimed in claim 5, integrative with modular elements equipped with vertical air spaces, wherein said groove devices to seal the conglomerate inside the structure consist, on the upper and lower longitudinal faces, of said arc of a circle sections (2,2') of equal radius of curvature, equipped with seams (3) acting as teeth, wherein:

the upper circle sections (2) extend to the respective inclined planes (6);

the lower circle sections (2') extend for the entire width of the sides;

said upper (2) and lower (2') circle sections run on the upper and lower edge of the closed vertical face and are interrupted in the points where the grooves overlap transversely, to form a single peripherical circuit interrupted only by the open vertical face of the element.

10. Modular building elements in any material, equipped with horizontal air spaces, able to realize a flat anti-seismic bearing structure which requires no reinforced concrete framework of pillars and beams and is self-sufficient whether made of strong modular elements or not since in either case the modular elements are symbiotically bonded to the internal network they form, characterized by:

support planes (12) along the edges of both upper and lower horizontal faces;

groove devices, to seal the conglomerate inside the structure, consisting of grooves (13) on upper horizontal face and copings (13') on the lower horizontal face, underneath said support planes;

inclined planes (6,6') from said grooves and coping (13,13') to the inside, with flat surfaces interrupted by two continuous parallel seams (7);

a continuous horizontal channel (4,4') along the center line underneath said inclined planes (6,6'), in each of said longitudinal faces;

continuous seams (7') along the walls of said horizontal channels;

holes (28) as vertical passageways through the central dividing mass on the sides of the element and through the end dividing masses;

pronounced seams (S) along the bottom of horizontal channel (4) and the top of horizontal channel (4');

vertical channels (5) running vertically to said horizontal channels (4,4');

openings (29) on parallel lines on the inside of each of the elements faces;

flat and smooth vertical transverse faces.

11. Modular building elements in any material equipped with horizontal air spaces, able to realize a vaulted bearing structure with anti-seismic properties, as claimed in claim 10, wherein said support planes defined by said upper horizontal face are arc of a circle (2) sections extending to the beginning of said inclined planes (6), and on said lower horizontal face are arc of a circle (2') sections of equal radius of curvature extending until the edges of the lower horizontal channel (4'), and both sections are equipped with seams (3) acting as teeth and at the same time as groove devices to seal the conglomerate inside the structure.

12. Modular building elements able to form a vaulted bearing with anti-seismic properties as claimed in claim 4, wherein said support planes on said upper horizontal face are arc of a circle (2) sections extending to the beginning of said inclined planes (6), and on said lower horizontal face are arc of a circle (2') sections of equal radius of curvature extending until the edges of the lower horizontal channel (4'), and both sections are equipped with seams (3) acting as teeth and at the same time as groove devices to seal the conglomerate inside the structure.

13. Polyvalent modular elements to replace accessory elements as claimed in claim 4, integrative with the modular elements with double horizontal channels wherein upper and lower horizontal (4,4') and vertical (5) channels are provided in equal numbers as the channels present on the modular elements they are integral with.

14. Polyvalent modular elements to replace accessory elements as claimed in claim 5, integrative with the modular elements, wherein said support planes on said upper horizontal face are arc of a circle (2) sections extending to the beginning of said inclined planes (6), and on said lower horizontal face are arc of a circle (2') sections of equal radius of curvature extending until the edges of the lower horizontal channel (4'), and both sections are equipped with seams (3) acting as teeth and at the same time as groove devices to seal the conglomerate inside the structure.

15. Modular building elements in any material equipped with vertical air spaces able to realize a flat and/or vaulted antiseismic bearing structure which requires no reinforced concrete framework of pillars and beams and which is self-sufficient whether made of strong modular elements or not since in either case the modular elements are symbiotically bonded to the internal network they form, characterized by:

a pair of laterally spaced support planes (12) separated by a central mass and by end masses, each of said pair of support planes defined by upper and lower horizontal faces and longitudinal faces, and vertical transverse faces, each of said horizontal faces defining a surface having a width substantially equal to but less than the width of said vertical transverse faces, said longitudinal faces extending the length of the element, and said vertical transverse faces having inclined planes (9);

said horizontal faces having a plurality of vertical openings (26) extending from the upper horizontal face to the lower horizontal face spaced along the length of said element to serve as air chambers, separated from one another (by 27) to allow, when two side-by-side elements are placed on the center line of the element underneath, the formation of a cementable space between said support planes, said horizontal faces and the inclined planes (9) of said vertical transverse faces, designed to this end with accentuated angles;

groove and coping devices to seal the conglomerate inside the structure, consisting of grooves (13) in the upper longitudinal faces of said support planes and of coping (13') in the lower longitudinal faces of said support planes, said groove and coping devices positioned on the inside of said support planes (12) and extending longitudinally along the inner edge of said horizontal faces, and also consisting of grooves (10) in one of the vertical transverse faces and coping (10') in the opposite one of said vertical transverse faces, said grooves (10) and coping (10') extending vertically from the upper horizontal faces to the lower horizontal faces and being off-set from the grooves (13) and coping (13') of said longitudinal faces;

seams (7'') running vertically on said vertical transverse faces and positioned inwardly of said grooves (10) and coping (10');

the space between said support planes (12) defining upper horizontal channel (4) and lower horizontal channel (4') divided by said central mass and end masses;

seams (7') running longitudinally along the walls of said upper horizontal channel (4) and the walls of said lower horizontal channel (4');

said central mass having an opening with its center aligned with the center line of the element;

said end dividing masses having cavities (11') at the ends of the elements; and pronounced seams (S) in the upper and lower surfaces of said dividing masses.

16. Modular building elements to realize a vaulted anti-seismic bearing structure as claimed in claim 15, wherein said support planes defined by said horizontal faces are arc of a circle sections with equal radius of curvature, equipped with seams (3) acting as teeth extending for the entire width of the sides and delimited on the inside by said grooves (13) and coping (13').

17. Modular building elements in any material able to realize a bearing structure with antiseismic properties, for flat brickwork, requiring no support framework consisting of pillars and beams and which is self-sufficient whether built with resistant modular elements or not, wherein in both cases the modular elements are symbiotically bonded to the network inside them, consisting of two longitudinal side faces joined to a central plane by several masses separated one from the other to form at least two vertical channels (5) next to one another and characterized by:

grooves (13) and coping (13') on upper and lower longitudinal faces near the inner edges of support planes (12) represented by flat and smooth surfaces, of overlaid elements, as well as by grooves (10) and coping (10') on anterior and posterior transverse faces on the sides of the element near the support planes of side-by-side elements, where all said grooves and coping (13,13',10,10') form a double network, each on a single continuous perimetrical sealing line inside all the support planes of overlaid and side-by-side elements;

at least two upper horizontal channels (4) and two lower horizontal channels (4') formed respectively at the sides of said central plane with continuous seams (7') in the vertical walls of said channels serving as devices to anchor the elements and the network when conglomerate is poured inside the structure;

pronounced seams (S) along the bottom and top of said horizontal channels (4,4'), respectively;

inclined planes (6,6') starting from said upper and lower grooves and coping (13,13') toward said channels (4,4') to form free spaces between overlaid elements, and in which continuous seams (7) act as anchor devices between the elements and the network when the conglomerate is poured;

two seams (7) along the entire upper and lower surface of said central plane, to act as anchorage devices between the elements and the network when the conglomerate is poured, where said plane is at a lower level than the support plane (12); and continuous inclined planes (9) along both transverse faces, starting from said sealing grooves and coping (10,10'), and running toward the opening of said horizontal channels (4,4') to form, on a line with the vertical plane, vertical free spaces between side-by-side elements, in which the conglomerate hardens.

18. Modular elements as claimed in any one of claims 1, 2, 3, 4, 5, 17, 12, 13 or 14, wherein the said inclined planes (9) on the transverse vertical faces as well as the tongue (11) and corresponding cavity (11') on the opposite transverse vertical face, are angled so as to form a dry joint, on direct contact, that is with no intermediate cement.

19. Modular elements as claimed in any one of claims 3, 5, 16, 9, 11, 8, 12 or 14, wherein said arc of a circle sections (2,2') have smooth surfaces, with no seams (3) with teeth.

20. Modular elements as claimed in any one of claims 3, 5, 16, 9, 11, 8, 12 or 14, wherein said upper arc of a circle sections (2) are equipped with seams (3) with teeth, where said lower arc of a circle sections (2') are smooth, with no seams (3) with teeth, or vice versa.

21. Polyvalent modular elements to replace accessory and integrative elements for the modular elements as claimed in any one of claims 4, 5, 6, 9, 7, 8, 13 or 14, wherein both vertical transverse faces are closed and present the same characteristics.

22. Modular elements as claimed in any one of claims 4, 5, 6, 9, 7, 8, 13 or 14, wherein the abutments (24)

provided on the inside of the thinner sections of the longitudinal sides and the respective holes (22, 22'), are open and continuous, detached from the bottom or top of the upper and lower horizontal channels (4,4').

23. Bearing structure, with anti-seismic properties, flat and/or vaulted, realized without the aid of a support framework consisting of reinforced concrete pillars and beams, with modular elements as claimed in any one of claims 2, 3, 15, 16, 10, 11, 17 or 12, also in combination with corresponding polyvalent modular elements, and involving a network of conglomerate poured inside the modular elements after they are assembled dry, where said network assumes shapes, forms and proportions to replace the pillars and beams in said reinforced concrete framework, forming at the same time a symbiotic bond between the elements and between the elements and the network.

24. Bearing structure, with anti-seismic properties, flat and/or vaulted, realized without the aid of a support framework consisting of reinforced concrete pillars and beams, with modular elements as claimed in claims 2, 3, 10, or 11, in combination with polyvalent modular elements, or involving a network of conglomerate from the two vetical channels of each element, which give rise to vertical seams (19) and to one horizontal seam (18) along a row of modular elements side-by-side, to replace respectively the pillars and beams of a reinforced concrete support framework, and also wherein said horizontal seams (18) consist of a central core resulting from the upper (4) and lower (4') horizontal longitudinal channels with the wing-shaped sides from the inclined planes (6,6';6,2') running along the upper and lower horizontal longitudinal sides of the element, where said wing shapes extend along the entire seam and up to the groove lines, and said core shows coping from seams (7') along the walls of said horizontal channels (4,4') which attach overlapping elements to the network and to one another through the network, while said wings show coping from seams (7) along said inclined planes (6,6') which attach the sides of the elements to the network and to one another through the network, where the actions of the former and latter coping are reciprocally complementary and the wings exert a side counter-push action with a stabilizing effect on the entire structure.

25. Bearing structure, with anti-seismic properties, flat and/or vaulted, realized without the aid of a support framework consisting of reinforced concrete pillars and beams, with modular elements as claimed in any one of claims 2, 3, 15, 16, 17 or 12, also in combination with corresponding polyvalent modular elements, wherein the conglomerate network is equipped with cemented reinforcement areas between side-by-side modular elements, resulting from a more accentuated receding angle of the inclined planes (9) of the transverse vertical faces of the elements, as well as the groove tongue (11) and the corresponding cavity (11') in the opposite transverse vertical face, where said cemented areas in cooperation with the core of the horizontal seam (18) formed by the longitudinal horizontal channels (4,4') and with the wings of said seam formed by the longitudinal inclined planes (6,6') create a continuous perimetrical strip around the modular elements on both the vertical and horizontal planes.

26. Bearing structure with anti-seismic properties, flat and/or vaulted, realized without the aid of a support framework consisting of reinforced concrete pillars and beams, with modular elements as claimed in claim 15 or 16, also in combination with polyvalent modular elements, and involving a network of conglomerate, which network forms vertical (19) and horizontal (18) seams to replace, respectively, the pillars and beams of a reinforced concrete support framework, where vertical seams (19) result from the vertical channels (5) and horizontal seams (18) result from the molding of the longitudinal horizontal channels (4,4'), and also wherein the network has alternating vertical cemented areas between the vertical seams (19) corresponding to the areas where two overlapping elements meet on the center line of an element underneath, aligned along one vertical plane, while inside said cemented areas, equipped with coping (7''), another vertical seam passes following a single uninterrupted straight line for the entire height of the structure.

27. Bearing structure, with anti-seismic properties, flat and/or vaulted, realized without the aid of a support framework consisting of reinforced concrete pillars and beams, with modular elements as claimed in claim 17 or 12, also in combination with polyvalent modular elements, wherein there are at least two parallel conglomerate networks which form vertical seams resulting from the vertical channels (5) and horizontal seams (19) to replace respectively the pillars and beams of a reinforced concrete support framework, and also wherein said horizontal seams (18) each consist of two cores resulting from at least two upper and lower longitudinal horizontal channels (4,4') divided one from the other by a wall parallel to them, where said cores have wing-shaped molding on the sides resulting from the inclined planes (6,6') running along the element's upper and lower longitudinal and horizontal sides, said wing-shaped moldings extending along the entire length of the seam, and where said cores and said dividing wall parallel to them present coping resulting from the seam (7') along the walls of said two or more horizontal channels (4,4') which attach the overlaid elements both to the network and to one another via the network, while said wings show coping resulting from the seams (7) along said inclined planes (6,6') and on the upper and lower faces of the dividing wall, which attach the respective sides of the elements to the network and to one another via the network, the actions of said former and latter coping being reciprocally complementary.

28. Bearing structure with anti-seismic properties, flat and/or vaulted, realized with modular elements as claimed in any one of claims 2, 3, 10, 11, 17 or 12, wherein said horizontal seams consist of a central core resulting from the upper (4) and lower (4') horizontal longitudinal channels with the wing-shaped molding on the sides, resulting from the inclined planes (6,6';6,2') running along the upper and lower horizontal longitudinal sides of the element, which wing-shaped molding extends in length the entire length of the seam and in width up to the lines of the joint, where said core acting as a beam presents coping, resulting from seams (7') along the walls of said horizontal channels (4,4') which attach the overlaid elements both to the network and to one another via the network, where the actions of said former and latter coping is reciprocally complementary and said wings exert a sideways counter thrust with a stabilizing effect on the entire structure.

29. Bearing structure as claimed in any one of claims 2, 3, 15, 16, 10, 11, 17 or 12, wherein the modular elements used are made of hard, compact materials which thus contribute to its bearing properties.

30. Bearing structure as claimed in any one of claims 2, 3, 15, 16, 10, 11, 17 or 12, wherein the modular elements used are made of less resistant materials and so the bearing function is performed by the network only.

31. Bearing structure as claimed in any one of claims 2, 3, 15, 16, 10, 11, 17 or 12, wherein iron rods are used.

32. Building construction realized with a bearing structure as claimed in any one of claims 2, 3, 15, 16, 10, 11, 17 or 12, wherein there is an uninterrupted network sequence, even in corners, cross points, and cross wall attachments, without the aid of a reinforced concrete support framework consisting of pillars and beams.

* * * * *